US010392921B2

(12) United States Patent
Jeffryes

(10) Patent No.: US 10,392,921 B2
(45) Date of Patent: Aug. 27, 2019

(54) DOWNHOLE TOOL FOR MEASURING ACCELERATIONS

(71) Applicant: SCHLUMBERGER TECHNOLOGY CORPORATION, Sugar Land, TX (US)

(72) Inventor: Benjamin Peter Jeffryes, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 171 days.

(21) Appl. No.: 15/552,740

(22) PCT Filed: Feb. 22, 2016

(86) PCT No.: PCT/US2016/018989
§ 371 (c)(1),
(2) Date: Aug. 22, 2017

(87) PCT Pub. No.: WO2016/137906
PCT Pub. Date: Sep. 1, 2016

(65) Prior Publication Data

US 2018/0051551 A1 Feb. 22, 2018

(30) Foreign Application Priority Data

Feb. 23, 2015 (GB) ..... 1502944

(51) Int. Cl.
*E21B 47/022* (2012.01)
*E21B 47/024* (2006.01)

(52) U.S. Cl.
CPC ..... *E21B 47/022* (2013.01); *E21B 47/024* (2013.01)

(58) Field of Classification Search
CPC ..... E21B 47/022
(Continued)

(56) References Cited

U.S. PATENT DOCUMENTS 4,399,692 A * 8/1983 Hulsing, II ..... E21B 47/022 33/313
5,646,611 A * 7/1997 Dailey ..... E21B 47/022 175/45

(Continued)

FOREIGN PATENT DOCUMENTS

WO 2014105025 A1 7/2014

*Primary Examiner* — George B Bennett

(57) ABSTRACT

A downhole tool is provided for measuring accelerations at a location within a subterranean borehole. The tool is rotatable around the longitudinal direction of the borehole. The tool includes four accelerometers, each accelerometer measuring acceleration in a respective direction and being arranged such that at least a component of its measured acceleration is normal to the longitudinal direction. The accelerometers are further arranged such that no more than any two of the four accelerometers have their respective components parallel to the same direction. The tool also includes a first device which measures the rotational speed of the tool. The tool also includes a processor unit which relates the acceleration measured by each accelerometer to the true acceleration at that accelerometer by a respective scaling term and a respective offset, and combines the measured accelerations and the tool rotational speed to re-calibrate the scaling terms as the tool rotates.

15 Claims, 3 Drawing Sheets

(58) Field of Classification Search
USPC ..... 33/304, 313
See application file for complete search history.

(56) References Cited

U.S. PATENT DOCUMENTS

| | | | | |
|---|---|---|---|---|
| 6,487,782 | B1 * | 12/2002 | Bond | E21B 47/022 33/302 |
| 7,730,625 | B2 | 6/2010 | Blake | |
| 2004/0149004 | A1 | 8/2004 | Wu | |
| 2004/0222019 | A1 | 11/2004 | Estes et al. | |
| 2008/0201969 | A1 | 8/2008 | Davies et al. | |
| 2010/0089572 | A1 * | 4/2010 | Chang | E21B 47/024 166/255.2 |
| 2010/0096186 | A1 * | 4/2010 | Ekseth | E21B 7/067 175/45 |
| 2016/0123134 | A1 * | 5/2016 | Viens | E21B 7/04 175/45 |

* cited by examiner

DOWNHOLE TOOL FOR MEASURING ACCELERATIONS

BACKGROUND

Embodiments of the present disclosure relate to a downhole tool for measuring accelerations.

Measurement while drilling (MWD) and logging while drilling (LWD) tools are commonly used in oilfield drilling applications to measure physical properties of a subterranean borehole and the geological formations through which it penetrates. Such MWD/LWD techniques include, for example, natural gamma ray, spectral density, neutron density, inductive and galvanic resistivity, acoustic velocity, acoustic caliper, downhole pressure, and the like. Formations having recoverable hydrocarbons typically include certain well-known physical properties, for example, resistivity, porosity (density), and acoustic velocity values in a certain range.

In some drilling applications it is desirable to determine the azimuthal variation of particular formation and/or borehole properties (i.e. the extent to which such properties vary about the circumference of the borehole). Such information may be utilized, for example, to locate faults and dips that may occur in the various layers that make up the strata. In geo-steering applications, such "imaging" measurements are utilized to make steering decisions for subsequent drilling of the borehole. In order to make correct steering decisions, information about the strata is generally required. As described above, such information may possibly be obtained from azimuthally sensitive measurements of the formation properties. Azimuthal imaging measurements typically make use of the rotation of the drill string (and therefore the LWD sensors) in the borehole during drilling.

In the present context, azimuthal position means angular position, at a measurement tool in borehole, around the longitudinal direction of the borehole relative to the direction of the Earth's magnetic field. More particularly, the azimuthal reference plane is a plane centred at the measurement tool and perpendicular to the longitudinal direction of the borehole at that point. This plane is fixed by the particular orientation of the measurement tool at the time the relevant measurements are taken. An azimuth is the angular separation in the azimuthal reference plane from a reference point to the measurement point. The azimuth is typically measured in the clockwise direction, and the reference point can be magnetic north.

For azimuthal imaging measurements, and indeed more generally in relation to downhole tools, it can be important to determine the orientation of the azimuthal reference plane relative to the vertical direction.

Accelerometers have conventionally been used to measure the vertical direction in boreholes. Any given accelerometer measures a combination of the acceleration due to rotation of the tool and also the acceleration due to gravity. By suitably arranging plural accelerometers and combining their measurements it is possible to determine the component of acceleration due to gravity in the reference plane, and thus determine the orientation of the plane. However, accelerometers can suffer from drift while deployed downhole, rendering their measurements inaccurate.

Therefore, there exists a need for an improved tool for measuring accelerations downhole, e.g. for determining the component of acceleration due to gravity for correlation with formation evaluation measurements.

SUMMARY

In a first aspect, embodiments of the present disclosure provide a downhole tool for measuring accelerations at a location within a subterranean borehole. The downhole tool is rotatable around the longitudinal direction of the borehole. The tool includes four accelerometers, where each accelerometer measures acceleration in a respective direction and is arranged such that at least a component of its measured acceleration is normal to the longitudinal direction of the borehole. The accelerometers are arranged so that no more than any two of the four accelerometers have their respective components parallel to the same direction. The downhole tool also includes a first device which measures the rotational speed of the tool or the time derivative thereof, and a processor configured to relate the acceleration measured by each accelerometer to the true acceleration at that accelerometer by a respective scaling term and a respective offset, and combine the measured accelerations and the tool rotational speed to re-calibrate the scaling terms as the tool rotates.

By combining these measurements, at least some of the difficulties of accelerometer drift can be overcome.

The four accelerometers may be further arranged such that first and second of the four accelerometers have their normal components parallel to a first direction and third and fourth of the four accelerometers have their normal components parallel to a second direction, the first and second directions being at an angle to each other around the longitudinal direction. For example, the first and second directions may be substantially at 90° to each other around the longitudinal direction.

In a second aspect, embodiments of the present disclosure provide a downhole tool for measuring accelerations at a location within a subterranean borehole, where the tool is rotatable around the longitudinal direction of the borehole. The downhole tool includes three accelerometers, where each accelerometer is configured to measure acceleration in a respective direction and is arranged such that at least a component of its measured acceleration is normal to the longitudinal direction of the borehole. The accelerometers are arranged so that the three accelerometers have their respective components in non-parallel directions. The tool further includes a first device which measures the rotational speed of the tool or the time derivative thereof and a processor configured to relate the acceleration measured by each accelerometer to the true acceleration at that accelerometer by a respective scaling term and a respective offset, and combine the measured accelerations and the tool rotational speed to re-calibrate the scaling terms as the tool rotates.

The three accelerometers may be further arranged such that their normal components are angled at least 30° apart from each other around the longitudinal direction. First and second of the three accelerometers may have their normal components substantially at 90° to each other around the longitudinal direction. The third of the three accelerometers may then have its normal component parallel to a direction which is substantially at 45° around the longitudinal direction to the normal components of the first and second of the three accelerometers.

In a third aspect, embodiments of the present disclosure provide a drillstring including the downhole tool according to the first or second aspect. The drillstring can include measurement or logging equipment, e.g. MWD or LWD equipment, directional drilling equipment, or rotary steerable equipment, all of which can benefit from improved acceleration measurements.

In a fourth aspect, embodiments of the present disclosure provide a use of the tool of the first or second aspect for measuring accelerations at a location within a subterranean borehole. For example, a method of measuring accelerations at a location within a subterranean borehole may include providing the tool of the first or second aspect at the location within the borehole; rotating the tool around the longitudinal direction of the borehole, and using the tool to calculate the accelerations of the tool.

Optional features of the invention will now be set out. These are applicable singly or in any combination with any aspect of the invention.

The processor unit may further combine the measured accelerations and the tool rotational speed to partially re-calibrate the offset terms as the tool rotates.

Conveniently, the first device may comprise a gyroscope to measure the rotational speed of the tool.

The downhole tool may further include a second device for measuring angular positions at the location within a subterranean borehole. The processor unit can then calculate the component of the Earth's gravitational acceleration normal to the longitudinal direction of the borehole from the measured accelerations and the measured angular position. Moreover, the processor unit, when the tool is not rotating, may re-calibrate the offset terms from the measured accelerations and the calculated component of the Earth's gravitational acceleration. This approach can further help to overcome problems associated with accelerometer drift.

Conveniently, the second device may comprise two or more magnetometers which measure the Earth's magnetic field along respective magnetometer axes, each magnetometer being arranged such that its measurement includes a component of the Earth's magnetic field normal to the longitudinal direction of the borehole, and the magnetometers being further arranged such that their normal components are at an angle to each other around the longitudinal direction. When the first device comprises a gyroscope, the processor may combine the measurements of the Earth's magnetic field and the tool rotational speed to calculate the angular positions of the tool around the longitudinal direction relative to the direction of the Earth's magnetic field. By combining these measurements, difficulties of poor magnetometer signal-to-noise ratio can be overcome.

The processor unit may filter the measured accelerations to the same bandwidth. The bandwidth may be at most 5% of the Nyquist frequency for the accelerometer measurements.

The accelerometers may be further arranged such that the measured acceleration of each accelerometer is normal to the longitudinal direction of the borehole.

Generally it is preferred to locate two of the accelerometers at the tool centre (e.g. with their respective normal components substantially at 90° to each other), although for some applications, for example where there has to be a hole in the middle of the tool, this is not possible.

The tool may have one or more further accelerometers measuring accelerations in respective directions and being arranged such that at least components of their measured accelerations are normal to the longitudinal direction of the borehole. For example, such further accelerometers can allow the tool to duplicate measurements, and/or allow the tool to have the accelerometer arrangements of the first and second aspects.

The tool may further include a telemetry unit for transmitting the measured accelerations and/or a storage unit for storing the measured accelerations. When the processor unit calculates the component of the Earth's gravitational acceleration normal to the longitudinal direction of the borehole, the tool may further include a telemetry unit (which can be the same unit as the previously-mentioned telemetry unit) for transmitting the calculated components and/or a storage unit (which can be the same unit as the previously-mentioned storage unit) for storing the calculated components.

BRIEF DESCRIPTION OF THE DRAWINGS

The present disclosure is described in conjunction with the appended figures. It is emphasized that, in accordance with the standard practice in the industry, various features are not drawn to scale. In fact, the dimensions of the various features may be arbitrarily increased or reduced for clarity of discussion.

Figure 1:
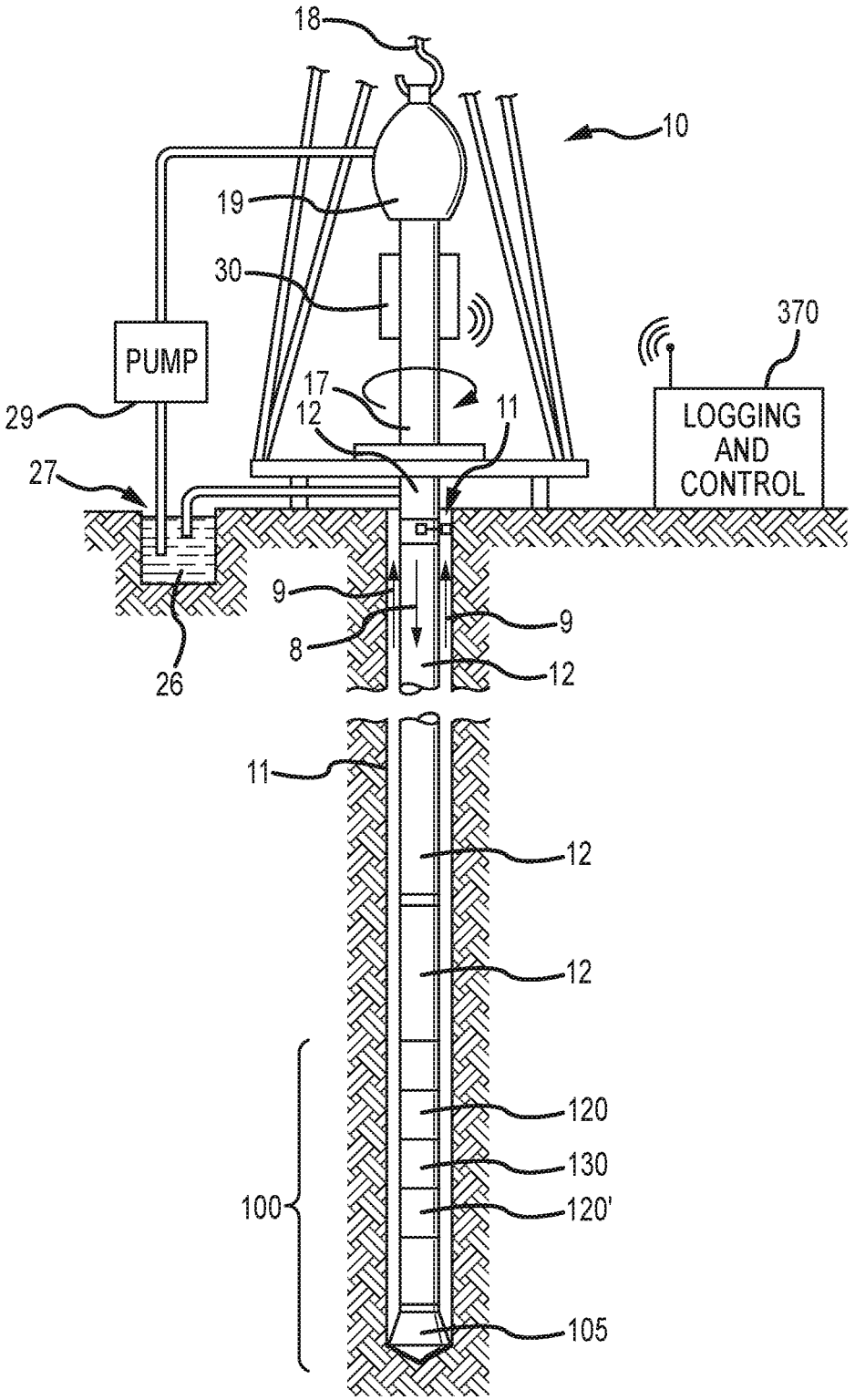
FIG. 1 illustrates a drilling system for operation at a wellsite to drill a borehole through an earth formation.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention, it being understood that various changes may be made in the function and arrangement of elements without departing from the scope of the invention.

Specific details are given in the following description to provide a thorough understanding of the embodiments. However, it will be understood by one of ordinary skill in the art that embodiments maybe practiced without these specific details. For example, well-known circuits, processes, algorithms, structures, and techniques may be shown without unnecessary detail in order to avoid obscuring the embodiments.

As disclosed herein, the term "storage unit" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "storage unit" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. One or more processors may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 illustrates a drilling system for operation at a wellsite to drill a borehole through an earth formation. The wellsite can be located onshore or offshore. In this system, a borehole 11 is formed in subsurface formations by rotary drilling in a manner that is well known. Systems can also use be used in directional drilling systems, pilot hole drilling systems, casing drilling systems and/or the like.

A drillstring 12 is suspended within the borehole 11 and has a bottomhole assembly 100, which includes a drill bit 105 at its lower end. The surface system includes a platform and derrick assembly 10 positioned over the borehole 11, the assembly 10 including a top drive 30, kelly 17, hook 18 and rotary swivel 19. The drillstring 12 is rotated by the top drive 30, energized by means not shown, which engages the kelly 17 at the upper end of the drillstring. The drillstring 12 is suspended from the hook 18, attached to a traveling block (also not shown), through the kelly 17 and the rotary swivel 19 which permits rotation of the drillstring relative to the hook. As is well known, a rotary table system could alternatively be used to rotate the drillstring 12 in the borehole and, thus rotate the drill bit 105 against a face of the earth formation at the bottom of the borehole.

The surface system can further include drilling fluid or mud 26 stored in a pit 27 formed at the well site. A pump 29 delivers the drilling fluid 26 to the interior of the drillstring 12 via a port in the swivel 19, causing the drilling fluid to flow downwardly through the drillstring 12 as indicated by the directional arrow 8. The drilling fluid exits the drillstring 12 via ports in the drill bit 105, and then circulates upwardly through the annulus region between the outside of the drillstring and the wall of the borehole, as indicated by the directional arrows 9. In this well-known manner, the drilling fluid lubricates the drill bit 105 and carries formation cuttings up to the surface as it is returned to the pit 27 for recirculation.

A control unit 370 may be used to control the top drive 30 or other drive system. The top drive 30 may rotate the drillstring 12 at a rotation speed to produce desired drilling parameters. By way of example, the speed of rotation of the drillstring may be: determined so as to optimize a rate of penetration through the earth formation, set to reduce drill bit wear, adjusted according to properties of the earth formation, or the like.

The bottomhole assembly 100 may include a logging-while-drilling (LWD) module 120, a measuring-while-drilling (MWD) module 130, a rotary-steerable system and motor, and drill bit 105.

The LWD module 120 may be housed in a special type of drill collar, as is known in the art, and can contain one or a plurality of known types of logging tools. It will also be understood that more than one LWD and/or MWD module can be employed, e.g. as represented at 120'. The LWD module may include capabilities for measuring, processing, and storing information, as well as for communicating with the surface equipment. The LWD module may include a fluid sampling device.

The MWD module 130 may also be housed in a special type of drill collar, as is known in the art, and can contain one or more devices for measuring characteristics of the drillstring and drill bit. The MWD tool may further includes an apparatus (not shown) for generating electrical power to the downhole system. This may typically include a mud turbine generator powered by the flow of the drilling fluid, it being understood that other power and/or battery systems may be employed. The MWD module may include one or more of the following types of measuring devices: a weight-on-bit measuring device, a torque measuring device, a vibration measuring device, a shock measuring device, a stick slip measuring device, a direction measuring device, a rotation speed measuring device, and an inclination measuring device.

The bottomhole assembly 100 includes one or more tools according to embodiments of the present disclosure for measuring accelerations. In particular, the tool, when rotatably coupled with the LWD module 120 and/or the MWD module 130, may allow calculations of the component of the Earth's gravitational acceleration normal to the longitudinal direction of the borehole, and hence determinations of the orientation of the tool, to be correlated with their measurements. Additionally or alternatively, the tool can be rotatably coupled with the rotary-steerable system to make correct steering decisions.

Figure 2A:
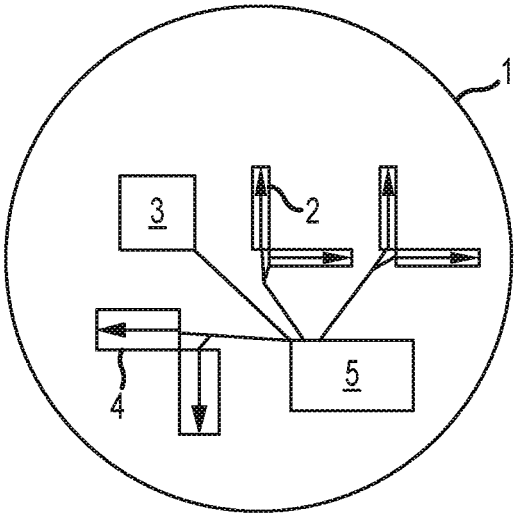
FIGS. 2A-C shows cross-sections (on a plane perpendicular to the longitudinal direction of the borehole) through embodiments of a tool for measuring accelerations.
Figure 2B:
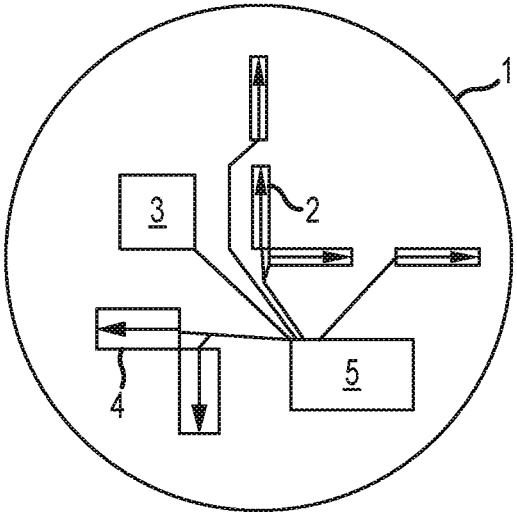
Figure 2C:
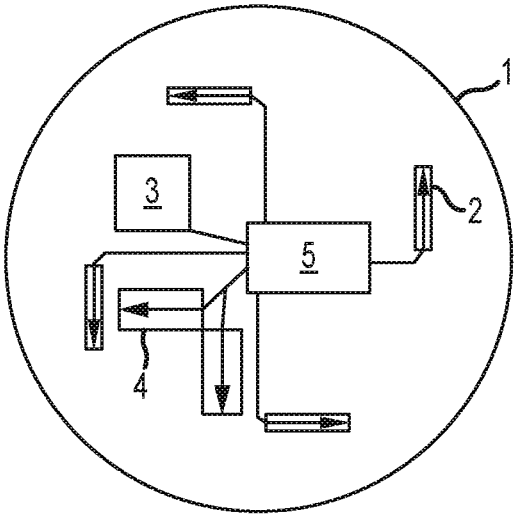

FIG. 2 shows cross-sections (on a plane perpendicular to the longitudinal direction of the borehole) through possible embodiments (a)-(c) of the tool, which has a housing 1 enclosing four accelerometers 2, an optional gyroscope 3, and two optional single-axis magnetometers 4. Measurement data from the accelerometers, and the gyroscope and magnetometers if present are sent to a processor unit 4, where the calculations described below are made. The tool can also have a telemetry unit and/or a data storage unit for respectively transmitting to the surface/storing for later retrieval the processed results (and optionally the raw measurement data).

The four accelerometers 2 are arranged such that their measured accelerations (indicated by respective arrows) are in a plane normal to the longitudinal direction of the borehole, this direction also being the axis about which the tool rotates. First and second of the accelerometers are aligned parallel to a first direction, and third and fourth of the accelerometers are aligned parallel to a second direction, the two directions being at 90° to each other. Other arrangements of the accelerometers are possible, as long as each accelerometer is arranged such that at least a component of its measured acceleration is normal to the longitudinal direction of the borehole, and no more than any two of the accelerometers have their respective components parallel to the same direction. However, the in-plane/90° arrangement is convenient and provides a relatively good signal-to-noise ratio.

Further, the use of more than four accelerometers may have advantages in improving signal-to-noise and improved redundancy.

The magnetometers 4 are arranged such that their axes (indicated by respective arrows) are also in the plane normal to the longitudinal direction of the borehole. The magnetometers are also arranged such that their axes are at 90° to each other around the longitudinal direction. Other arrangements of the magnetometers are possible, as long as each magnetometer measures a component of the Earth's magnetic field normal to the longitudinal direction of the borehole, and these components are at an angle to each other around the longitudinal direction. However, the in-plane/90° arrangement is convenient and provides a relatively good signal-to-noise ratio. Further, the use of more than two magnetometers may have advantages in improving signal-to-noise and improved redundancy. At low frequencies, the measurements from the magnetometers reflect well the actual dynamics of the drillstring. However, the magnetometers can suffer from poor signal-to-noise ratios, particularly when measuring angular positions affected by relatively high frequency variations in rotation speed.

The gyroscope 3 produces an output which is nominally proportional to the rotational speed of the tool. Like the magnetometer measurements, the gyroscope measurements reflect well the actual dynamics of the drillstring at low frequencies. Unlike the magnetometer measurements, they continue to reflect the dynamics of the drillstring at higher frequencies. A problem with the gyroscope measurements, however, is that they are susceptible to drift. Thus if the gyroscope measurement is insufficiently accurate by itself, one option, discussed in more detail in the following Appendix, is to combine the gyroscope and magnetometer measurements. This allows the gyroscope to be continuously calibrated, while also enabling an accurate calculation of the angular position of the tool. Effectively, the magnetometer and gyroscope measurements can be phase-locked. The angular position measurement can then benefit from the stability of the magnetometers and the good signal-to-noise ratio of the gyroscope.

The following analysis assumes that there are four accelerometers as described above. If more than four accelerometers are used, then the analysis may be straightforwardly extended to cover these as well.

In a stationary laboratory environment, accelerometers are easy to calibrate to a linear model with reasonable accuracy (so long as the accelerometers are not low-frequency limited).

More particularly, an accelerometer output A may be related to the actual acceleration field (sum of gravitational specific force and acceleration) a, by:

$$A=ka+c \tag{i}$$

Then if two measurements are made, one with the accelerometer vertical and pointing upwards ($A_u$) and one with the accelerometer vertical and pointing downwards ($A_d$), and if g is the Earth's gravitational acceleration:

$$c = \frac{1}{2}(A_u + A_d) \tag{ii}$$

-continued $$k = \frac{A_u + A_d}{2g}$$

For accelerometers located in a drilling tool, no such calibration is possible. The sensors cannot be controllably located pointing up or down, and while calibration can and should be done before drilling commences, the effects of temperature and other unpredictable environmental changes the calibration.

However, if the accelerometers are rotated, and the rotation speeds are known (e.g. by a gyroscope measurement), then the accelerations induced by rotation can be used as calibration.

A possible arrangement of the accelerometers is in co-located pairs at right-angles, for example as shown in FIG. 2(*a*). However, the method applies for any four accelerometers with known positions and directions, so long as they measure coplanar components of acceleration, and no more than any two such components are parallel.

Let the first pair of accelerometers be positioned at distance n from the centre of rotation, with one accelerometer ($x_1$) at angle θ to the radial direction, and the other accelerometer ($y_1$) at the same angle to the direction tangential to the rotation.

The second pair of accelerometers are oriented in the same directions, at distance $r_2$ from the centre of rotation, at an angle φ from the first pair. Accelerometers $x_2$ and $y_2$ are oriented in the same directions as $x_1$ and $y_1$ respectively.

The two x accelerometers will be subject to the same motions of the centre of rotation of the tool, but different rotational components, and similarly the two y accelerometers.

The rotational accelerations may be split into two components—the centripetal k (in a direction radial to the rotation), and the tangential t (in a direction tangential to the rotation). In terms of the rotation speed of the tool ω, at a unit distance from the centre of rotation:

$$\kappa = \omega^2 \tag{iii}$$

$$\tau = \frac{d\omega}{dt}$$

Thus:

$$x_1=x_0+r_1\cos(\theta)\kappa+r_1\sin(\theta)\tau$$

$$y_1=y_0-r_1\sin(\theta)\kappa+r_1\cos(\theta)\tau$$

$$x_2=x_0+r_2\sin(\varphi-\theta)/\kappa+r_2\cos(\varphi-\theta)\tau$$

$$y_2=y_0-r_2\cos(\varphi-\theta)\kappa+r_2\sin(\varphi-\theta)\tau \tag{iv}$$

The four quantities $x_1$, $y_1$, $x_2$ and $y_2$ are the actual accelerations at the measurement locations. After initial calibration, there are four measured quantities, $\xi_1$, $\xi_2$, $\eta_1$ and $\eta_2$ at those locations, connected to the actual accelerations by:

$$\xi_1=\alpha_1(x_1+\beta_1)$$

$$\xi_2=\alpha_2(x_2+\beta_2)$$

$$\eta_1=\gamma_1(y_1+\beta_1)$$

$$\eta_2=\gamma_2(y_2+\delta_2) \tag{v}$$

Thus:

$$\frac{1}{\gamma_2}\eta_2 - \frac{1}{\gamma_1}\eta_1 + (\delta_1 - \delta_2) = (r_1\sin(\theta) - r_2\cos(\varphi-\theta))\kappa + (r_2\sin(\varphi-\theta) - r_1\cos(\theta))\tau = \rho \quad \text{(vi)}$$

$$\frac{1}{\alpha_2}\xi_2 - \frac{1}{\alpha_1}\xi_1 + (\beta_1 - \beta_2) = -(r_1\cos(\theta) - r_2\sin(\varphi-\theta))\kappa + (r_2\cos(\varphi-\theta) - r_1\sin(\theta))\tau = \sigma$$

If the coefficients in these equations can be estimated while the tool is rotating, then this provides six relationships between the eight unknowns in equations (v).

From the calculated values of $\kappa$ and $\tau$, and the measured values $\xi_1$, $\xi_2$, $\eta_1$ and $\eta_2$, first all the quantities are filtered to the same bandwidth, and then the following expectation values are continuously calculated:

$$\langle\eta_1^2\rangle, \langle_2^2\rangle, \langle\eta_1\eta_2\rangle, \langle\eta_1\rangle, \langle\eta_2\rangle, \langle_1\rho\rangle, \langle\eta_2\rho\rangle, \langle\rho\rangle$$

$$\langle\xi_1^2\rangle, \langle\xi_2^2\rangle, \langle\xi_1\xi_2\rangle, \langle\xi_1\rangle, \langle\xi_1\sigma, \langle\xi_2\sigma\rangle, \langle\sigma\rangle$$

Since the time-derivative of the rotation speed is not measured directly by the gyroscope, but only calculated by differencing, to avoid any intrinsic high-frequency filtering effects of the sensors and acquisition filters, the bandwidth chosen should be a small fraction of Nyquist frequency, for instance 1/20.

Using these expectation values:

$$\begin{pmatrix} \frac{1}{\gamma_2} \\ -\frac{1}{\gamma_1} \\ \delta_1 - \delta_2 \end{pmatrix} = \begin{pmatrix} \langle\eta_2\rho\rangle \\ \langle\eta_1\rho\rangle \\ \langle\rho\rangle \end{pmatrix} \begin{pmatrix} \langle\eta_2^2\rangle & \langle\eta_1\eta_2\rangle & \langle\eta_2\rangle \\ \langle\eta_1\eta_2\rangle & \langle\eta_1^2\rangle & \langle\eta_1\rangle \\ \langle\eta_2\rangle & \langle\eta_1\rangle & 1 \end{pmatrix}^{-1} \quad \text{(vii)}$$

$$\begin{pmatrix} \frac{1}{\alpha_2} \\ -\frac{1}{\alpha_1} \\ \beta_1 - \beta_2 \end{pmatrix} = \begin{pmatrix} \langle\xi_2\sigma\rangle \\ \langle\xi_1\sigma\rangle \\ \langle\sigma\rangle \end{pmatrix} \begin{pmatrix} \langle\xi_2^2\rangle & \langle\xi_1\xi_2\rangle & \langle\xi_2\rangle \\ \langle\xi_1\xi_2\rangle & \langle\xi_1^2\rangle & \langle\xi_1\rangle \\ \langle\xi_2\rangle & \langle\xi_1\rangle & 1 \end{pmatrix}^{-1}$$

It can be seen that the four scale factors ($\alpha$ and $\gamma$) can be estimated, but only the differences between the offsets $\beta$ and $\delta$.

Thus the scale factors can be recalibrated as the tool rotates by combining the measured accelerations and the tool rotational speed, while the offsets can be only partially recalibrated in this way. However, if the angle between the accelerometers and a fixed (or nearly fixed) direction in the Earth can be estimated, such as by using magnetometers, or a combination of magnetometers and a gyroscope (as described in the Appendix), then this can be combined with the accelerometer measurements to obtain the values of $\beta$ and $\delta$.

There are other methods to calculate the scale factors, which employ correlation between the accelerometer and the known centripetal and angular acceleration terms, but which do not explicitly involve the matrix inversion methods described above. Additionally, in a deviated well, to reduce noise, the variation in gravitational acceleration that is synchronous to the tool's rotation (as determined, for example, using magnetometers) can be employed as a "test" signal, the relative responses to which determining the relative scale factors of the accelerometers.

Let $\nu$ be the fixed direction. Then converting to Earth coordinates, at every time sample there are four accelerations:

$$\begin{pmatrix} \chi_1 \\ \lambda_1 \end{pmatrix} = \begin{pmatrix} \cos(\nu) & \sin(\nu) \\ -\sin(\nu) & \cos(\nu) \end{pmatrix} \begin{pmatrix} \frac{\xi_1}{\alpha_1} - (r_1\cos(\theta)\kappa + r_1\sin(\theta)\tau) \\ \frac{\eta_1}{\gamma_1} - (-r_1\sin(\theta)\kappa + r_1\cos(\theta)\tau) \end{pmatrix} \quad \text{(viii)}$$

$$\begin{pmatrix} \chi_2 \\ \lambda_2 \end{pmatrix} = \begin{pmatrix} \cos(\nu) & \sin(\nu) \\ -\sin(\nu) & \cos(\nu) \end{pmatrix} \begin{pmatrix} \frac{\xi_2}{\alpha_2} - (r_2\sin(\varphi-\theta)\kappa + r_2\cos(\varphi-\theta)\tau) \\ \frac{\eta_2}{\gamma_2} - (-r_2\cos(\varphi-\theta)\kappa + r_2\sin(\varphi-\theta)\tau) \end{pmatrix}$$

where $\chi_1$ and $\lambda_1$ are the equivalents of $x_1$ and $y_1$ in Earth coordinates, and $\chi_2$ and $\lambda_2$ are the equivalents of $x_2$ and $y_2$. On average, these are the components of the Earth's gravity in the two orthogonal directions. Thus while rotating:

$$\langle\chi_1\rangle = \langle\chi_2\rangle = g_\chi$$

$$\langle\lambda_1\rangle = \langle\lambda_2\rangle = g_\lambda$$

The constant term has disappeared, as the time-average of this is zero.

When rotation stops, the measured value of $\chi$ and $\lambda$ include the constant terms, thus:

$$\chi_1 - \langle\chi_1\rangle = \cos(\nu)\beta_1 + \sin(\nu)\delta_1$$

$$\lambda_1 - \langle\lambda_1\rangle = \cos(\nu)\delta_1 \sin(\nu)\beta_1$$

$$\chi_2 - \langle\chi_2\rangle = \cos(\nu)\beta_2 + \sin(\nu)\delta_2$$

$$\lambda_2 - \langle\lambda_2\rangle = \cos(\nu)\delta_2 - \sin(\nu)\beta_2 \quad \text{(x)}$$

In this way, the offset terms can be re-calibrated when the tool is not rotating.

Figure 3:
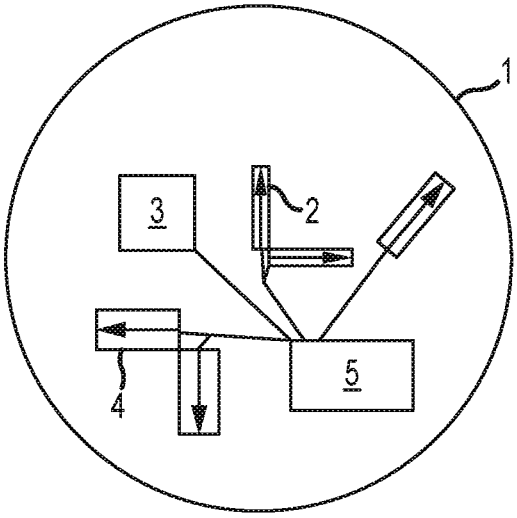
FIG. 3 shows a cross-section (on a plane perpendicular to the longitudinal direction of the borehole) through a possible embodiment of a further tool for measuring accelerations.

FIG. 3 shows a cross-section (on a plane perpendicular to the longitudinal direction of the borehole) through a possible embodiment of a further tool, which has a housing 1 enclosing three accelerometers 2, an optional gyroscope 3, and two optional single-axis magnetometers 4. Details of the magnetometers and the gyroscope are as discussed above. Like the embodiments of FIG. 2, measurement data from the accelerometers, and the gyroscope and magnetometers if present are sent to a processor unit 4, where the calculations described below are made. Also like the embodiments of FIG. 2, the tool can have a telemetry unit and/or a data storage unit for respectively transmitting to the surface/storing for later retrieval the processed results (and optionally the raw measurement data).

The three accelerometers 2 are arranged such that their measured accelerations (indicated by respective arrows) are in a plane normal to the longitudinal direction of the borehole, this direction also being the axis about which the tool rotates. First and second of the accelerometers are aligned substantially at 90° to each other. The third accelerometer is aligned substantially at 45° to the other two. Other arrangements of the three accelerometers are possible, but generally they should be angled at least 30° apart from each.

The following analysis assumes that there are three accelerometers as described above. If more than three accelerometers are used, then the analysis may be straightforwardly extended to cover these as well. Equations (i) to (iii) of the previous analysis for the embodiments of FIG. 2 apply also to the following analysis The first two accelerometers 90° apart and at a distance $r_1$ from the centre of rotation are denoted as the previous analysis by x and y. The third accelerometer is at a distance $r_2$ from the centre of rotation, oriented at an angle of ε to the direction of the x accelerometer, and positioned an angle φ around the axis of the tool, and is denoted z. Thus:

$$x=x_0+r_1\cos(\theta)\kappa+r_1\sin(\theta)\tau$$

$$y=y_0-r_1\sin(\theta)\kappa+r_1\cos(\theta)\tau$$

$$z=x_0\cos(\varepsilon)+y_0\sin(\varepsilon)+r_2\sin(\varphi+\varepsilon-\theta)\kappa+r_2\cos(\varphi+\varepsilon-\theta)\tau \quad \text{(xi)}$$

The three quantities x, y and z are the actual accelerations at the measurement locations. After initial calibration, there are three measured quantities, ξ, η and ζ at those locations, connected to the actual accelerations by:

$$\xi=\alpha(x+\beta)$$

$$\eta=\gamma(y+\delta)$$

$$\zeta=\mu(z+\nu) \quad \text{(xii)}$$

where ζ is the measured quantity linearly related to z by the offset v and the scale factor μ.

Thus:

$$\frac{\zeta}{\mu}-\cos(\varepsilon)\frac{\xi}{\alpha}-\sin(\varepsilon)\frac{\eta}{\gamma}-\nu+\cos(\varepsilon)\beta+\sin(\varepsilon)\delta= \quad \text{(xiii)}$$
$$r_2\sin(\varphi+\varepsilon-\theta)\kappa+r_2\cos(\varphi+\varepsilon-\theta)\tau-$$
$$\cos(\varepsilon)(r_1\cos(\theta)\kappa+r_1\sin(\theta)\tau)-\sin(\varepsilon)(r_1\sin(\theta)\kappa-r_1\cos(\theta)\tau)=\omega$$

Following a similar procedure to that described in the previous analysis, using the calculated values of κ and τ to determine ω, the expectation values of ξ, η and ζ and their products can be calculated, along with the expectation values of the products of ξ, η, ζ with ω, and the expectation value of ω.

$$\begin{pmatrix}\frac{1}{\mu}\\ -\cos(\varepsilon)\frac{1}{\alpha}\\ -\sin(\varepsilon)\frac{1}{\gamma}\\ -\nu+\cos(\varepsilon)\beta+\sin(\varepsilon)\delta\end{pmatrix}=\begin{pmatrix}\langle\zeta\omega\rangle\\ \langle\xi\omega\rangle\\ \langle\eta\omega\rangle\\ \langle\omega\rangle\end{pmatrix}\begin{pmatrix}\langle\zeta^2\rangle & \langle\zeta\xi\rangle & \langle\zeta\eta\rangle & \langle\zeta\rangle\\ \langle\zeta\xi\rangle & \langle\xi^2\rangle & \langle\xi\eta\rangle & \langle\xi\rangle\\ \langle\zeta\eta\rangle & \langle\xi\eta\rangle & \langle\eta^2\rangle & \langle\eta\rangle\\ \langle\zeta\rangle & \langle\xi\rangle & \langle\eta\rangle & 1\end{pmatrix}^{-1} \quad \text{(xiv)}$$

Thus the scalings μ, α and γ may be recalibrated as the tool rotates, along with one linear combination of the v, β and δ to partially re-calibrate the offsets.

The procedure for calibrating the offsets then follows in an analogous manner to that described in the previous analysis, for example, by estimating the angle between the accelerometers and a fixed direction in the Earth and then combining this estimate with the with the accelerometer measurements to obtain the values of v, β and δ when the tool is not rotating.

For real-time use, continuous estimation of scale factors and offsets, using analyses such as those described above are employed. However, once the data has been recorded, in post-processing the entire data set may be employed to find the best estimates of scale factors and offsets for the entire data set (which may not be constant), and from which improved estimation of the actual accelerations seen downhole may be obtained.

APPENDIX

The following analysis concerning the combination of gyroscope and magnetometer measurements assumes that there are two magnetometers as described above. The extension to more than two magnetometers is straightforward and is described subsequently.

The magnetometer output m is proportional to the magnetic component M in the direction of the magnetometer axis, plus an offset term. Thus for the two magnetometer outputs $m_x$ and $m_y$ we have:

$$m_x=m_{x0}+A_xM_x$$

$$m_y=m_{y0}+A_yM_y \quad (1)$$

where $m_{x0}$, $m_{y0}$, $A_x$ and $A_y$ vary slowly with time, and in the absence of noise:

$$M_x=\cos(\theta)$$

$$M_y=\sin(\theta+\tau) \quad (2)$$

where θ is the angle between the axis of magnetometer $m_x$ and the direction of the Earth's magnetic field, and the angle between the two magnetometers is π/2+τ, τ being the departure from exactly 90° of the angle between the magnetometer axes. Whereas the amplitudes $A_x$ and $A_y$ depend on the direction of the plane of the magnetometers with respect to the earth's magnetic field, and so vary with borehole trajectory, in theory the offsets $m_{x0}$ and $m_{y0}$ are constant for a perfect magnetometer. In reality, however, all of $A_x$, $A_y$, $m_{x0}$ and $m_{y0}$ are susceptible to drift. Additionally, any misalignment of the magnetometers which results in their not being precisely aligned with the plane of rotation of the tool results in a component of the Earth's magnetic field along the direction of rotation being present as a slowly varying component.

The gyroscope signal ω is related to the true rotation speed Ω by a similar linear relationship:

$$\omega=\omega_0+\frac{1}{\rho}\Omega \quad (3)$$

where $\omega_0$ and ρ also slowly vary with time. Some gyroscopes show a small but consistent error proportional to the cube of the rotation speed. This may be corrected for by first applying a correction term to ω which is proportional to ω cubed.

Thus, to derive good estimates of the angle θ and the rotation speed Ω, it is necessary to know the six slowly varying calibration quantities $A_x$, $A_y$, $m_{x0}$, $m_{y0}$, $\omega_0$ and ρ.

An algorithm is described below for calculating θ and Ω, and also for continuously calibrating the magnetometers and gyroscope. However, in order to start the algorithm, initial values for $A_x$, $A_y$, $m_{x0}$, $m_{y0}$, $\omega_0$ and ρ are needed.

If the gyroscope has previously been calibrated, then the initial values of $$\omega_0=0$$

$$\rho=1 \quad (4)$$

may be used. Another option, however, is to base the initial calibration on a previous period of use of the gyroscope. From such a period of use, for example, average values of $\omega_0$ and ρ can be determined suitable for initiating a next period of use.

An option for obtaining initial calibration values for the magnetometers is to sample the magnetometers over a period of time when the tool is known to be rotating. The extremal values of $m_x$ and $m_y$ can be recorded from this period, and the following equations used to derive $A_x$, $A_y$, $m_{x0}$ and $m_{y0}$.

$$m_{x0}=\tfrac{1}{2}(\max(m_x)+\min(m_x))$$

$$m_{y0}=\tfrac{1}{2}(\max(m_y)+\min(m_y))$$

$$A_x=\tfrac{1}{2}(\max(m_x)-\min(m_x))$$

$$A_y=\tfrac{1}{2}(\max(m_y)-\min(m_y)) \tag{5}$$

Given a set of calibration quantities, the three variables $M_x$, $M_y$ and $\Omega$ can be calculated. From these the single variable $\theta$ must be derived, where (ignoring noise terms), $M_x$, $M_y$ and $\Omega$ are linked to $\theta$ by the equations:

$$M_x = \cos(\theta) \tag{6}$$

$$M_y = \sin(\theta + \tau)$$

$$\Omega = \frac{d\theta}{dt}$$

In order to find the best $\theta$, a quadratic error term can be derived. Assuming that at time-step j, there is already an angle estimate for the previous time-step j−1, the error function can be:

$$E=K_X(M_X\cos(\theta_j))^2+K_Y(M_Y-\sin(\theta_j+\tau))^2+C(\theta_j-(\theta_{j-1}+\Omega dt))^2 \tag{7}$$

where $K_x$, $K_y$ and C are weighting quantities, and dt is the time between samples. Rather than find the value of $\theta_j$ which minimizes E, it can be quicker to start from the initial updated value using the gyro rotation speed measurement:

$$\theta_0=\theta_{j-1}+\Omega dt \tag{8}$$

and then use gradient descent to improve this, obtaining:

$$\theta_j = \theta_0 - \frac{1}{C}[K_X\sin(\theta_0)(M_X - \cos(\theta_0)) - K_Y\cos(\theta_0 + \tau)(M_Y - \sin(\theta_0 + \tau))] \tag{9}$$

The choice of appropriate values for the weighting quantities $K_x$, $K_y$ and C used in the error minimization is discussed below. To modify of these equations for more than two magnetometers it is simply a matter of including extra terms in equations (7) and (9) corresponding to the extra magnetometers.

Having calculated the sequence $\theta_j$, this can be used to adjust $A_x$, $A_y$, $m_{x0}$, and $m_{y0}$.

From $m_{x0}$, $A_x$ and $\theta$ a theoretical magnetometer reading $\mu x$ can be calculated:

$$\mu_X=m_{0x}+A_X\cos(\theta) \tag{10}$$

Let $$d_X=m_x-\mu_X \tag{11}$$

If $m_x$ is correct then $d_x$ should be zero mean. By taking a long-time average of $d_x$, and adjusting $m_{x0}$ with this, $d_x$ can be adjusted. Thus for some small value $\delta$, the average value of $d_X$ can be estimated using exponential averaging:

$$\langle d_x\rangle(j)=(1-\delta)\langle d_x\rangle\langle(j-1)+\delta d_x \tag{12}$$

and this then used to incrementally adjust the offset $m_{0x}$:

$$m_{0x}(j)=m_{0x}(j-1)+\delta\langle d_x\rangle(j) \tag{13}$$

and similarly for the other magnetometer(s). The adjustment coefficient $\delta$ in equation (13) is the same as in equation (12), although this is not essential.

A related approach can be used to adapt the amplitude. The error term (similar to $d_x$ above) used to adjust the amplitude should be of one sign when $A_x$ is too small, and of opposite sign when Ax is too large. Such an error term is $f_x$ defined in equation (14)

$$f_x=|M_x|-|\cos(\theta)| \tag{14}$$

This will be zero mean if $A_x$ is correct.

However, if an average value of $f_x$ is calculated and, used to adjust $A_x$ in a similar manner to the use of $d_x$ to adjust $m_{0x}$, then instabilities can result. By only calculating $f_x$ when the absolute value of $\cos(\theta)$ is close to one, these instabilities can be avoided. Thus:

If $|\cos(\theta)|>\tfrac{3}{4}$ $$f_x=(|M_x|-|\cos(\theta)|)$$

$$\langle f_x\rangle(j)=(1-\delta)\langle f_x\rangle(j-1)+\delta f_x$$

If $|\cos(\theta)|<\tfrac{3}{4}$ $$f_x=0$$

$$\langle f_x\rangle(j)=\langle f_x\rangle(j-1)$$

and the amplitude is modified according to:

$$A_X(j)=A_X(j-1)+\delta\langle f_x\rangle \tag{15}$$

Similarly, the calibration of the gyroscope can be corrected using the deviation term in equation (9). Let $$\varepsilon = \frac{1}{C}[K_X\sin(\theta_0)(M_X - \cos(\theta_0)) - K_Y\cos(\theta_0 + \tau)(M_Y - \sin(\theta_0 + \tau))] \tag{16}$$

If the gyroscope is calibrated correctly, then $\varepsilon$ will be zero mean, and hence the long term average of $\varepsilon$ can be used to adjust the gyro calibration. However, there are two gyro calibration constants (offset $\omega_0$ and scaling $\rho$), and this is just one adjustment.

In normal drilling operations, there are lengthy periods during which no rotation takes place (for example, connections, when additional pipe is added to the drillstring). During these periods, the offset term $\omega_0$ can be adjusted to zero the gyroscope output, and at other times the deviation term $\varepsilon$ can be used to adjust the scaling $\rho$. Thus, while rotating the tool the offset $\omega_0$ is kept constant and the scaling $\rho$ adjusted, and while the tool is stationary the scaling is kept constant the offset adjusted.

A simple approach for identifying periods of no-rotation is to use the rotation speed derived from the calculated angle $\theta_j$, (see equations (20) and (21) below for a method of calculation). Only when the absolute value of this, or a low-pass filtered version of it, is below a threshold is the offset term $\omega_0$ adjusted. When the absolute value or low-pass filtered version is above this threshold then the deviation term is used to adjust the scaling $\rho$.

Other methods for continuously estimating offsets and amplitudes may also be employed, for instance by exploiting the fact that if $m_x$ is proportional to the cosine of an angle, and $m_y$ is proportional to the sine of the same angle with the same proportionality then the sum of the squares of $m_x$ and $m_y$ will be constant over time. If $m_x$ and $m_y$ are given by equation (1) then $$m_x^2+m_y^2 \approx \tfrac{1}{2}(A_x^2+A_y^2)+2m_{x0}m_x+2m_{y0}m_y+\tfrac{1}{2}(A_x^2-A_y^2)\cos(2\theta)+\tau A_y^2\sin(2\theta) \quad (16a)$$

By calculating the correlation between the sum of the squares of $m_x$ and $m_y$, and $m_x$ and $m_y$ individually, using equation (16a), the offset terms $m_{x0}$ and $m_{y0}$ may be estimated, either using continuous methods or calculating the correlation over past data periods. The difference between the squared amplitude $A_x$ and $A_y$ may also be calculated by combining this with a correlation against an estimate of $\cos(2\theta)$.

Returning then to the weightings used in the error minimization at equation (9). $K_x$, $K_y$ and C are related to the signal-to-noise level. If the signal-to-noise level on $m_x$ is high, then $K_x$ should be high, and similarly for $K_y$ in relation to signal-to-noise level on $m_y$.

In addition, attention must be paid to the relative bandwidth of the different measurements. Since $K_x$ and $K_y$ only appear divided by C, there are in fact only two weightings to be chosen. A convenient choice is thus to set $$K_x+K_y=1 \quad (17)$$

Normally, the gyroscope bandwidth is significantly higher than the magnetometer bandwidth. If the sampling frequency is higher than the magnetometer bandwidth, then the high frequency component of the magnetometer signals will just be noise, and so the weighting C must be sufficiently large that the high frequency noise has a negligible effect on the final angle estimate.

The relative size of $K_x$ and $K_y$ can be determined by the relative signal-to-noise ratio of the two magnetometers. One approach to estimating the relative signal-to-noise is to consider the mean square of the error terms $V_x$ and $V_y$:

$$V_X(j)=(1-g)V_X(j-1)+g(M_X-\cos(\theta_t))^2$$

$$V_Y(j)=(1-g)V_Y(j-1)+g(M_y-\sin(\theta_t+\tau))^2 \quad (18)$$

where g is a small forgetting factor.

The greater the signal-to-noise of a given magnetometer, the smaller the corresponding error term. However, if the error for $m_y$ is less than $m_x$ and is then used to increase $K_y$, a subsequent value of θ will fit $m_y$ better than $m_x$ (since more weight has been given to $m_y$), resulting in a short while to $m_x$ being ignored. In order to avoid this, a test estimate of θ can be continuously calculated, using $K_x=K_y=0.5$. The mean square error term resulting from this estimate can then be used to generate $K_x$ and $K_y$.

Turning to the weighting C, this depends both on the relative signal-to-noise of the gyroscope and the magnetometers, and the bandwidth. A relationship such as:

$$C=C_0+C_1(V_X+V_Y) \quad (19)$$

can be used, where $C_0$ and $C_1$ are constants.

The gyroscope may go out of range or malfunction for periods of time. To reduce problems that this can cause data from the magnetometers can be used as a pseudo-gyroscope. More particularly, when the two magnetometers are at 90°, the angular rotation speed dθ/dt is given by:

$$\frac{d\theta}{dt}=M_x\frac{dM_y}{dt}-M_y\frac{dM_x}{dt} \quad (20)$$

or more strictly, if the y magnetometer is shifted by an angle τ, (as in equation (6)), the relation is:

$$\frac{(1-\sin^2\tau)}{\cos\tau}\frac{d\theta}{dt}=M_x\left(\frac{dM_y}{dt}-\frac{dM_x}{dt}\sin\tau\right)-(M_y-M_x\sin\tau)\frac{dM_x}{dt} \quad (21)$$

This estimate of the rotation speed is relatively noisy, so a short average can be taken and this value then be substituted for Ω in equation (8). In addition, a different value of C can be used. In particular, since the magnetometer-derived rotation speed is noisier than the gyroscope-derived speed, the value of C can be reduced. Further, if an average rotation speed is taken, this delays the rotation speed measurement, and thus the angle update can also be delayed so that the magnetometer readings are synchronized with the rotation speed estimate.

During periods in which the gyroscope is unavailable, the gyroscope weighting is not updated. To ensure that any errors that occur during this period do not cause problems subsequently, the long-term average of ε can be reset to zero.

A malfunctioning gyroscope can be detected by monitoring the difference between the gyroscope measurement, and the angular-rotation measured by the magnetometers, filtered to the same bandwidth. The gyroscope can be susceptible to shock, and during and for a short time after such events it can provide bad data. By swapping the gyroscope reading for the magnetometer-derived rotation speed during a period surrounding the time when the two readings differ by more than a threshold (which can depend on the signal-to-noise ratio of the magnetometers) these errors may be largely eliminated. However, such an approach also requires a delay in the measurements.

FIG. 5 shows a frequency spectrum for the same drill-string data as FIGS. 1 and 4 but analysed according to embodiments of the present disclosure by combining the magnetometer and gyroscope measurements. The spectrum has a similar frequency content to the gyroscope spectrum of FIG. 4, but it is now locked to the magnetometer phase.

In the first embodiment described above, the gyroscope 3 produces an output which is nominally proportional to the rotational speed of the tool. However, another option is to combine measurements of the time derivative of rotational speed with the magnetometer measurements. Accordingly, FIG. 6 shows a cross-section (on a plane perpendicular to the longitudinal direction of the borehole) through a second embodiment of the tool, which has a housing 1 enclosing two single-axis magnetometers 2 and number of accelerometers 5*a, b, c*. Measurement data from the magnetometers and the accelerometers are sent to a processor unit 4, where the calculations described below are made. The tool can also have a telemetry unit and/or a data storage unit for respectively transmitting to the surface/storing for later retrieval the processed results (and optionally the raw measurement data).

Rotational acceleration may be determined by taking a linear combination of the in-plane accelerometer measurements. For example, the combination may be the difference between the readings from a first accelerometer 5*a* mounted in the centre of rotation, and a second accelerometer 5*b* pointing in the same direction, mounted on a radius normal to the accelerometer direction, divided by the distance of the second accelerometer from the centre. Another option for the combination is to take the sum of the readings of two accelerometers 5*a*, 5*c*, mounted on a diameter, and pointing normal to the diameter in opposite directions, divided by the distance between the two accelerometers. Other combinations are also possible.

The analysis is similar to that based on a gyroscope measurement of rotational speed. The magnetometers 4 and accelerometers 5*a-c* provide three measurements:

$$M_x = \cos(\theta) \tag{22}$$

$$M_y = \sin(\theta + \tau)$$

$$a = \frac{d^2\theta}{dt^2}$$

where a is rotational acceleration. Initial updates for the angle and rotation speed are obtained using:

$$\omega_0 = \omega_{j-1} + a_j dt$$

$$\theta_0 = \theta_{j-1} + \omega_0 dt \tag{23}$$

To obtain the rotational acceleration, the measured acceleration is preferably high-pass filtered to remove any offset in the measurement. A simple one-pole filter is convenient, to avoid delay. Accordingly, if $\alpha_j$ is the unfiltered acceleration, then:

$$a_L = (1-\delta)a_L + \delta\alpha_j$$

$$a_j = \alpha_j - a_L \tag{24}$$

A high-pass frequency of around 0.025 Hz may be used, such that:

$$\delta = \frac{dt}{40} \tag{25}$$

The rotation speed and angle derived from the accelerometers are then sequentially adjusted using the magnetometer data: This is very similar to the approach originally used to update the angle $\theta_j$. First the angular velocity and angle derived from the initial angle velocity updates are corrected using an error term $\eta$ proportional to that used in equation (9):

$$\eta = \frac{1}{Cdt}[K_X \sin(\theta_0)(M_X - \cos(\theta_0)) - K_Y \cos(\theta_0 + \tau)(M_Y - \sin(\theta_0 + \tau))]$$

$$\omega_j = \omega_0 - \eta$$

$$\theta_1 = \theta_0 - \eta dt$$

Then the final angle estimate is obtained applying the correction again, using the improved angle estimate:

$$\theta_j = \theta_1 - \frac{1}{C}[K_X \sin(\theta_1)(M_X - \cos(\theta_1)) - K_Y \cos(\theta_1 + \tau)(M_Y - \sin(\theta_1 + \tau))] \tag{26}$$

This algorithm calculates an angular position and an angular velocity, but the angular velocity $\omega_j$ is not the time derivative of the angular position $\theta_j$. If it is desired that the angular velocity is equal to the time derivative of the angular position, then the angular position may simply be differenced. For example:

$$\Omega_j = \frac{\theta_j - \theta_{j-1}}{dt} \tag{27}$$

The raw magnetometer measurements can be calibrated using the same approaches as described above in respect of the first embodiment. Similarly, the weighting constants $K_x$ and $K_y$ can be determined in a similar way as described above.

The calculated angle and angular speed can have significant errors if the accelerometers are noisy. In particular, accelerometers can suffer from significant non-random noise over short periods, e.g. due to saturation or shocks. However, similarly to the approach described above for dealing with a malfunctioning gyroscope, a rotation speed can be calculated from the accelerometers alone and compared with the rotation speed calculated from the magnetometers. If the two diverge significantly, then the magnetometer-derived rotation speed may be used for $\omega_j$ in equation (26), until the accelerometers have recovered. This can be achieved by comparing the low-frequency component of the angular acceleration measured by accelerometers with the component of the time-derivative of the magnetometer-derived rotation speed over the same bandwidth, and using the magnetometer-derived rotation speed when the two readings differ by more than a threshold.

The invention claimed is:

1. A downhole tool for measuring accelerations at a location within a subterranean borehole, the tool being rotatable around a longitudinal direction of the borehole, the downhole tool comprising:

four accelerometers, each accelerometer configured to measure acceleration in a respective direction and arranged such that at least a component of the measured acceleration is normal to the longitudinal direction of the borehole, wherein the accelerometers are arranged such that no more than any two of the four accelerometers have components that are parallel;

a first device which measures the rotational speed of the tool; and a processor unit which relates the acceleration measured by each accelerometer to the true acceleration at that accelerometer by a respective scaling term and a respective offset, and combines the measured accelerations and the tool rotational speed to re-calibrate the scaling terms as the tool rotates.

2. The downhole tool according to claim 1, wherein the accelerometers are further arranged such that first and second of the four accelerometers have their normal components parallel to a first direction and third and fourth of the four accelerometers have their normal components parallel to a second direction, the first and second directions being at an angle to each other around the longitudinal direction.

3. The downhole tool according to claim 2, wherein the first and second directions are substantially at 90° to each other around the longitudinal direction.

4. A downhole tool for measuring accelerations at a location within a subterranean borehole, the tool being rotatable around a longitudinal direction of the borehole and including:

three accelerometers, each accelerometer measuring acceleration in a respective direction and being arranged such that at least a component of the acceleration measured in the respective direction is normal to the longitudinal direction of the borehole, wherein the accelerometers are arranged such that the respective components of the three accelerometers that are each normal to the longitudinal direction are not parallel;

a first device which measures the rotational speed of the tool or the time derivative thereof; and a processor unit which relates the acceleration measured by each accelerometer to the true acceleration at that accelerometer by a respective scaling term and a respective offset, and combines the measured accelerations and the tool rotational speed to re-calibrate the scaling terms as the tool rotates.

5. The downhole tool according to claim 4, wherein the three accelerometers are further arranged such that their normal components are angled at least 30° apart from each other around the longitudinal direction.

6. The downhole tool according to claim 5, wherein first and second of the three accelerometers have their normal components substantially at 90° to each other around the longitudinal direction.

7. The downhole tool according to claim 1, wherein the processor unit further combines the measured accelerations and the tool rotational speed to partially re-calibrate the offset terms as the tool rotates.

8. The downhole tool according to claim 1, wherein the first device comprises a gyroscope which measures the rotational speed of the tool.

9. The downhole tool according to claim 1, further comprising:

a second device for measuring angular positions at the location within a subterranean borehole, wherein the processor unit is configured to calculate the component of the Earth's gravitational acceleration normal to the longitudinal direction of the borehole from the measured accelerations and the measured angular position.

10. The downhole tool according to claim 9, wherein the processor unit, when the tool is not rotating, re-calibrates the offset terms from the measured accelerations and the calculated component of the Earth's gravitational acceleration.

11. The downhole tool according to claim 9, wherein the second device comprises two or more magnetometers which measure the Earth's magnetic field along respective magnetometer axes, each magnetometer being arranged such that its measurement includes a component of the Earth's magnetic field normal to the longitudinal direction of the borehole, and the magnetometers being further arranged such that their normal components are at an angle to each other around the longitudinal direction.

12. The downhole tool according to claim 1, wherein the processor unit filters the measured accelerations to the same bandwidth.

13. The downhole tool according to claim 12, wherein the bandwidth is at most 5% of the Nyquist frequency for the accelerometer measurements.

14. The downhole tool according to claim 1, wherein the accelerometers are further arranged such that the measured acceleration of each accelerometer is normal to the longitudinal direction of the borehole.

15. The downhole tool according to claim 1, further including a telemetry unit for transmitting the measured accelerations and/or a storage unit for storing the measured accelerations.

* * * * *